US009571914B1

(12) United States Patent
Chan

(10) Patent No.: US 9,571,914 B1
(45) Date of Patent: Feb. 14, 2017

(54) EARBUD HEADPHONES THAT CONVERT INTO AN ACCESSORY

(71) Applicant: Head First Ventures, LLC, Philadelphia, PA (US)

(72) Inventor: Vanessa Chan, Philadelphia, PA (US)

(73) Assignee: REDESIGN STUDIO, LLC, Philadelphia, PA (US)

( * ) Notice: Subject to any disclaimer, the term of this patent is extended or adjusted under 35 U.S.C. 154(b) by 0 days.

(21) Appl. No.: 14/944,687

(22) Filed: Nov. 18, 2015

Related U.S. Application Data

(60) Provisional application No. 62/207,752, filed on Aug. 20, 2015.

(51) Int. Cl.

| | |
|---|---|
| ***H04R 1/00*** | (2006.01) |
| ***H04R 1/10*** | (2006.01) |
| ***H04R 1/02*** | (2006.01) |
| ***H04R 5/033*** | (2006.01) |

(52) U.S. Cl.
CPC ..... *H04R 1/1033* (2013.01); *H04R 1/028* (2013.01); *H04R 1/1016* (2013.01); *H04R 1/1058* (2013.01); *H04R 5/033* (2013.01); *H04R 5/0335* (2013.01); *H04R 2201/023* (2013.01); *H04R 2201/105* (2013.01)

(58) Field of Classification Search
CPC ..... H04R 1/1016; H04R 1/1033; H04R 1/105; H04R 1/1058; H04R 1/1066; H04R 5/033; H04R 5/0335; H04R 2201/105; H04R 2420/07; H04R 2201/023
USPC ..... 381/301, 309, 370, 374, 380, 384, 385; 379/430, 438; 181/129, 130, 135
See application file for complete search history.

(56) References Cited

U.S. PATENT DOCUMENTS

| | | | | |
|---|---|---|---|---|
| 7,436,974 | B2 * | 10/2008 | Harper | H04R 1/1033 381/374 |
| 8,761,430 | B2 | 6/2014 | Zimmerman | |
| 2007/0121987 | A1 * | 5/2007 | Fielding | H04R 1/1033 381/385 |
| 2010/0150370 | A1 | 6/2010 | Bales et al. | |
| 2014/0205108 | A1 | 7/2014 | Triato | |

OTHER PUBLICATIONS

Chadbourne, "Android & iPhone Magnetic Headphone and Earbud Cables!", https://www.kickstarter.com/projects/1724723766/slackersheadphones-re-invented, Downloaded Mar. 16, 2016.
Elroy Project, "Bluetooth Earbuds w/ Magnetic Docking. Made in USA.", https://www.kickstarter.com/projects/363428889/bluetooth-earbuds-w-magnetic-docking-made-in-usa. Downloaded Mar. 16, 2016.

(Continued)

*Primary Examiner* — Huyen D Le
(74) *Attorney, Agent, or Firm* — MH2 Technology Law Group LLP

(57) ABSTRACT

Headphones are provided that can be formed into one or more loops of sufficient size to be worn as an accessory when the headphones are not in use. The one or loops can be formed by a magnetic closure. The headphones can be worn as a necklace, a bracelet, or around the waist. The cord of the headphones can be accessorized with one or more additional components including a chain, a thread, multiple threads, a wire, a string of beads, or a string of charms.

6 Claims, 8 Drawing Sheets

(56) References Cited

OTHER PUBLICATIONS

Cho, "Zipi: magnetic earbud strap", https://www.kickstarter.com/projects/746130101/zipi-magnetic-earbud-strap. Downloaded Mar. 16, 2016.
Kord Lord, "Kord Lord—Magnetic Earbud Cord Manager", https://www.kickstarter.com/projects/1994396857/kord-lord-magnetic-earbud-cord-manager. Downloaded Mar. 16, 2016.
Mackay, "Nearbuds and their Nearbuddy—Magnetic Earbud accessories", https://www.kickstarter.com/projects/2024830331/nearbuds-and-their-nearbuddy-magnetic-earbud-acces. Downloaded Mar. 16, 2016.
Johnson, "Clippies: Magnetic Earbud Clips", https://www.kickstarter.com/projects/139996405/clippies-magnetic-earbud-clips. Downloaded Mar. 17, 2016.
Ebay, "Handcandy HF003MT Stereo Headphone Earbud Necklace w/Magnetic Clasp—Samba", http://www.ebay.com/itm/HANDCANDY-HF003MT-Stereo-Headphone-Earbud-Necklace-w-Magnetic-Clasp-Samba-/181206011555?pt=LH_DefaultDomain_0&hash=item2a30b84ea3. Downloaded Mar. 17, 2016.

* cited by examiner

EARBUD HEADPHONES THAT CONVERT INTO AN ACCESSORY

CROSS REFERENCE TO RELATED APPLICATIONS

This application claims benefit of priority to U.S. Provisional Application No. 62/207,752 titled "EARBUDS THAT CONVERT INTO JEWELRY" filed on Aug. 20, 2015, which is hereby incorporated by reference in its entirety.

TECHNICAL FIELD

The present disclosure relates generally to earbud headphone cords, and more specifically to an earbud headphone cord that can be worn as an accessory when not in use.

BACKGROUND

For busy people who are constantly on the phone, one of the largest frustrations is the time wasted finding their earbud headphones, untangling them and then plugging the earbud headphones into their phone for a call. There is a need for a product that will allow easy access to their earbud headphones and limit wasted time.

SUMMARY

In accordance with aspects consistent with the present disclosure, a system for magnetically coupling headphones to form one or more loops is provided. The system can comprise a first earbud of the headphones coupled to a first magnet having a first polarity side and second polarity side, wherein the first polarity side of the first magnet is exposed; an audio jack of the headphones, wherein the audio jack comprises a material that is attracted to the first polarity side of the first magnet, and a first audio cable connecting the first earbud to the audio jack; wherein the first audio cable has a length sufficient to form a loop that can be worn as an accessory by a user when the audio jack is magnetically coupled to the first polarity side of the first magnet.

In some aspects, the material can be a diamagnetic material, paramagnetic material, ferromagnetic material, superparamagnetic material, molecule-based magnetic material, spin glass magnetic material, or a polymer-based magnetic material.

In some aspects, the system can further comprise a second earbud coupled to a second magnet having a first polarity side and a second polarity side, wherein the first polarity side of the second magnet is exposed.

In some aspects, the first magnet can be coupled near a first junction of the first earbud and a first audio cable and the second magnet can be coupled near a second junction of the second earbud and a second audio cable.

In some aspects, the first magnet and the second magnet can be coupled using a selectively removable connection or a permanent connection. The permanent connection can be based on epoxy, resin, or solder.

In some aspects, the loop can be further accessorized with one or more additional components comprising a chain, a thread, multiple threads, a wire, a string of beads, or a string of charms.

In some aspects, the first magnet can be coupled using a first coupling comprising a first aperture sized to accommodate the first junction and the one or more additional components and the second magnet is coupled using a second coupling comprising a second aperture sized to accommodate the second junction and the one or more additional components.

In accordance with aspects consistent with the present disclosure, a system for magnetically coupling a headphone in a loop is provided. The system can comprise a first magnet having a first polarity side exposed and coupled near a first earbud of the headphone; a second magnet having the first polarity side exposed and coupled near a second earbud of the headphone; and a third magnet having a second polarity side exposed and coupled near an audio jack of the headphone, wherein the second polarity is opposite the first polarity.

In some aspects, the first magnet can be coupled near a first junction of the first earpiece and a first audio cable and the second magnet can be coupled near a second junction of the second earbud and a second audio cable.

In some aspects, the first magnet and the second magnet can be coupled using a selectively removable connection or a permanent connection. The permanent connection can be based on epoxy, resin, or solder.

In accordance with aspects consistent with the present disclosure, a system for magnetically coupling a headphone in a loop is provided. The system can comprise a first magnet coupled to a first connector sized to accommodate passage of a first portion of an audio cable, wherein the first magnet has a first polarity side exposed; a second magnet coupled to a second connector sized to accommodate passage of a second portion of the audio cable, wherein the second magnet has the first polarity side exposed; and a third magnet coupled to a third connector sized to accommodate passage of a third portion of the audio cable, wherein the third magnet has a second polarity side exposed, wherein the second polarity is opposite the first polarity.

In accordance with aspects consistent with the present disclosure, a system for magnetically coupling a headphone to form a loop is provided. The system can comprise a first earbud of the headphone coupled to a first material; an audio jack of the headphone coupled to a first magnet having a first polarity side exposed; and an audio cable connecting the first earbud and the audio jack; wherein the headphone forms a loop of sufficient diameter to be worn as an accessory by a user when the first material is magnetically coupled to the first magnet.

In some aspects, the system can further comprise a second earbud of the headphone coupled to a second material.

In some aspects, the first material and/or the second material can be a diamagnetic material, paramagnetic material, ferromagnetic material, superparamagnetic material, molecule-based magnetic material, spin glass magnetic material, or a polymer-based magnetic material.

In accordance with aspects consistent with the present disclosure, a system for magnetically coupling a headphone to form a loop is provided. The system can comprise a first earbud of the headphone coupled to a first magnet having a first polarity side and second polarity side, wherein the first polarity side of the first magnet is exposed; an audio jack of the headphone; a coupler disposed near the audio jack comprising a material that is attracted to the first polarity side of the first magnet, an audio cable connecting the first earbud and the audio jack, wherein the audio cable forms a loop of sufficient diameter to be worn as an accessory by a user when the material is magnetically coupled to the first polarity side of the first magnet.

In accordance with aspects consistent with the present disclosure, a system for magnetically coupling a headphone to form a loop is provided. The system can comprise an earbud of the headphone coupled to a first magnet having a first polarity side and second polarity side, wherein the first polarity side of the first magnet is exposed; and an audio jack of the headphone, wherein the audio jack is coupled by a coupler to a second magnet having a second polarity side, wherein the first polarity is opposite the second polarity, an audio cable connecting the first earbud to the audio jack, wherein the audio cable forms a loop of sufficient diameter to be worn as an accessory by a user when the second magnet is magnetically coupled to the first polarity side of the first magnet.

In accordance with the aspects consistent with the present disclosure, a system for magnetically coupling a headphone to form one or more loops is provided. The system can comprise a first earbud of the headphone coupled to a first magnet having a first polarity side and second polarity side, wherein the first polarity side of the first magnet is exposed; a second earbud of the headphone coupled to a second magnet having a first polarity side and a second polarity side, wherein the first polarity side of the second magnet is exposed; an audio jack of the headphone, wherein the audio jack comprises a material that is attracted to the first polarity side of the first magnet and the first polarity side of the second magnet, an audio cable connecting the first earbud, the second earbud, and the audio jack, wherein the audio cable forms a loop of sufficient diameter to be worn as an accessory by a user when the audio jack is magnetically coupled to the first polarity side of the first magnet, the first polarity side of the second magnet, or both.

In accordance with aspects consistent with the present disclosure, a system for magnetically coupling headphones to form one or more loops is provided. The system can comprise a first earbud of the headphones coupled to a first magnet having a first polarity side and second polarity side, wherein the first polarity side of the first magnet is exposed; a second earbud coupled to a second magnet having a first polarity side and a second polarity side, wherein the first polarity side of the second magnet is exposed; an audio jack of the headphone, wherein the audio jack is coupled by a coupler to a third magnet and a fourth magnet, wherein the third magnet and the fourth magnet have a second polarity side exposed, wherein the first polarity is opposite the second polarity, an audio cable connecting the first earbud and the second earbud to the audio jack; wherein the audio cable has a length sufficient to form a loop that can be worn as an accessory by a user when the first magnet is magnetically coupled to the third magnet and the second magnet is magnetically coupled to the fourth magnet.

In accordance with aspects consistent with the present disclosure, a system for magnetically coupling a headphone to form a loop is provided. The system can comprise a first earbud of the headphone comprising a first magnet; an audio jack of the headphone comprising a material that is attracted to the first magnet having a first polarity side exposed; and an audio cable connecting the first earbud and the audio jack; wherein the headphone forms a loop of sufficient diameter to be worn as an accessory by a user when the material is magnetically coupled to the first magnet. A second earbud of the headphone can also be provided comprising a second material. The first and the second material can be a material that is attracted to a magnet.

In accordance with aspects consistent with the present disclosure, a system for magnetically coupling a headphone to form a loop is provided. The system can comprise a first earbud of the headphone comprising a material that is attracted to a magnet; an audio jack of the headphone comprising a magnet; and an audio cable connecting the first earbud and the audio jack; wherein the headphone forms a loop of sufficient diameter to be worn as an accessory by a user when the material is magnetically coupled to the magnet.

In some aspects, the audio cord can be further accessorized with one or more additional components comprising a chain, a thread, multiple threads, a wire, a string of beads, or a string of charms, wherein the one or more additional components can be coupled to the audio cable.

It is to be understood that both the foregoing general description and the following detailed description are exemplary and explanatory only and are not restrictive of the disclosure, as claimed.

BRIEF DESCRIPTION OF THE DRAWINGS

The drawings are not necessarily to scale. Instead, emphasis is generally placed upon illustrating the principles of the disclosures described herein. The accompanying drawings, which are incorporated in and constitute a part of this specification, illustrate several embodiments consistent with the disclosures and together with the description, serve to explain the principles of the disclosures. In the drawings.

DETAILED DESCRIPTION

Figure 1:
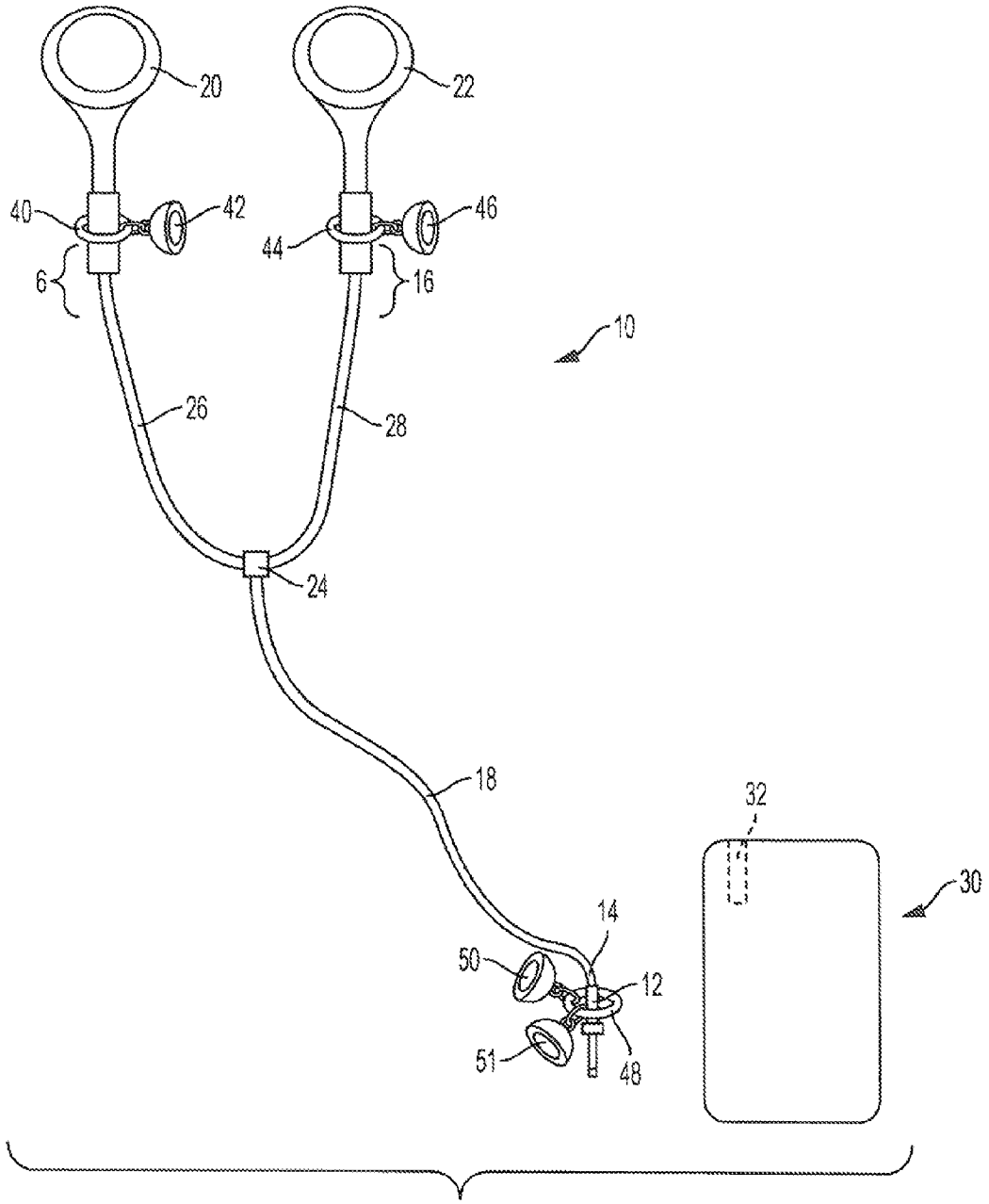
FIG. 1 is an example of a set of earbud headphones that can be used with an associated electronic device, according to embodiments of the present disclosure.

The following detailed description refers to the accompanying drawings. Wherever possible, the same reference numbers are used in the drawings and the following description to refer to the same or similar parts. Also, similarly-named elements perform similar functions and are similarly designed, unless specified otherwise. Numerous details are set forth to provide an understanding of the embodiments described herein. The embodiments may be practiced without these details. In other instances, well-known methods, procedures, and components have not been described in detail to avoid obscuring the embodiments described. While several exemplary embodiments and features are described herein, modifications, adaptations, and other implementations are possible, without departing from the spirit and scope of the disclosure. Accordingly, the following detailed description does not limit the disclosure. Instead, the proper scope of the disclosure is defined by the appended claims.

For purposes of description herein, the terms "upper," "lower," "right," "left," "rear," "front," "vertical," "horizontal," and derivatives thereof shall relate to the orientation shown in FIG. 1. However, it is to be understood that the various example provided herein may assume various alternative orientations, except where expressly specified to the contrary. It is also to be understood that the specific devices and processes illustrated in the attached drawings, and described in the following specification are simply exemplary embodiments of the disclosed concepts defined in the appended claims. Hence, specific dimensions and other physical characteristics relating to the embodiments disclosed herein are not to be considered as limiting, unless the claims expressly state otherwise.

As used throughout this disclosure, the terms "earbud headphone" or "headphone" or plural forms thereof, are used to identify any type of device that provides audio sound to a listener's ear, whether such device is inserted into the listener's ear or is placed adjacent to the listener's ear externally. The terms "earpiece," "earbuds" or "earphones" refer to the portions of the headphones that are placed in or near a user's ear. Thus, "earbud headphones" or "headphones" refer to an apparatus having one or more earbuds/earphones/earpiece as well as the associated cords or audio cables used to electronically transmit sound or audio data to the earbuds/earphones/earpiece. A plug member, also referred to herein as an audio jack or audio plug, is also generally included with the headphones and is used to couple the headphones to a mating member on an electronic device, such as a mobile phone.

Many individuals who use earbud headphones experience frustration with tangled, hard to find and often broken headphones. Oftentimes individuals may drape headphones around their neck which not only can slip when they move, but are unattractive. Thus, the various examples disclosed herein provide headphones which have been decorated so they are more visually appealing and more secure while not being used. The decorated headphones can include one or more magnets or materials attracted to a magnet that can be secured near the audio jack. A magnet or a material that can be attracted to a magnet can also be secured near, coupled with, or comprise part of each of the earbuds. A "loop" or multiple loops can be formed when the magnet or material attracted to a magnet at the audio jack connects to the magnet at the earbuds. In this secured form, the various examples provided herein can be worn as a necklace or a bracelet or encircle other parts of the body as an accessory (e.g., belt, armband, necklace).

Figure 2:
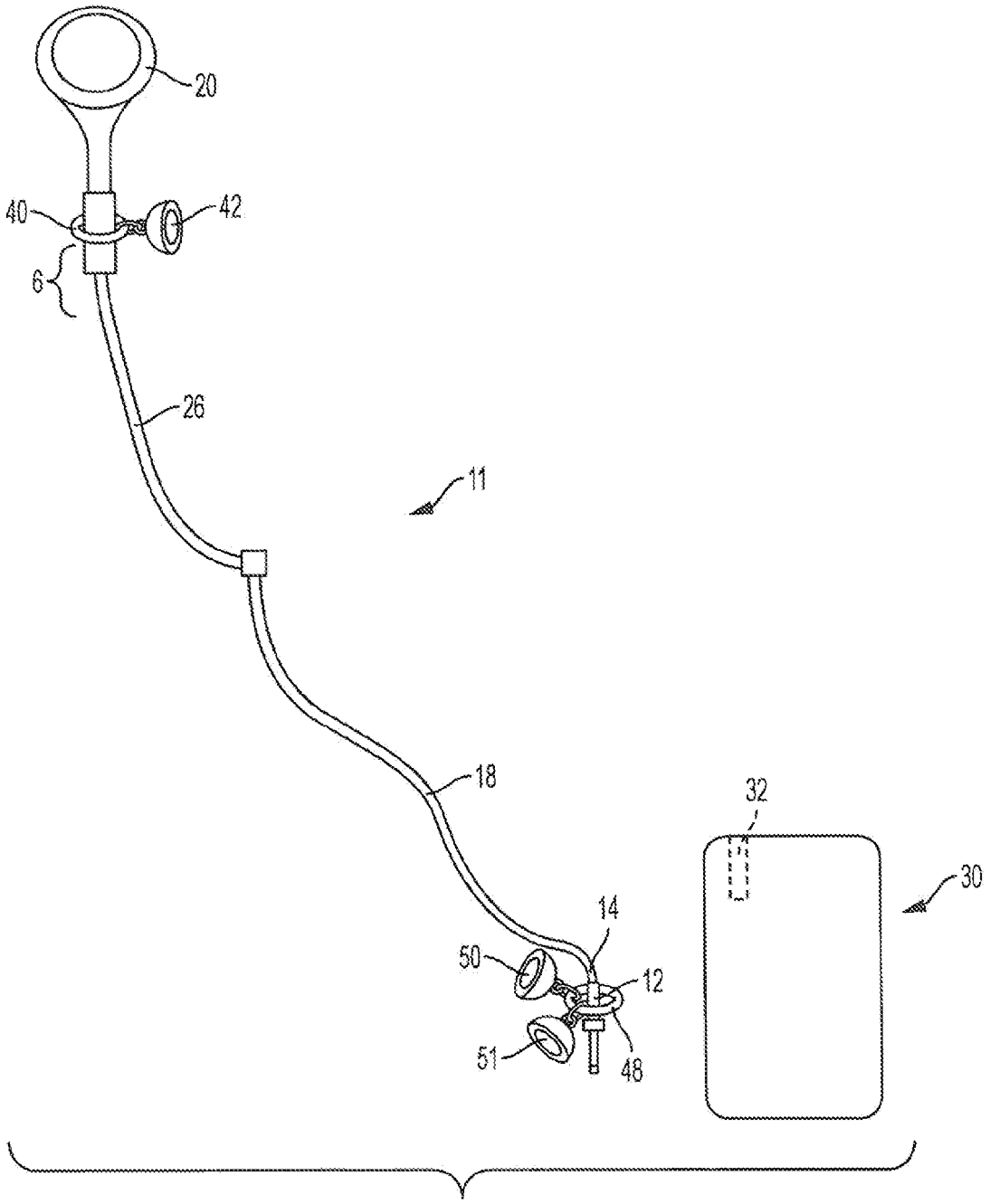
FIG. 2 is another example of an earbud headphone that can be used with an associated electronic device, according to embodiments of the present disclosure.
Figure 7:
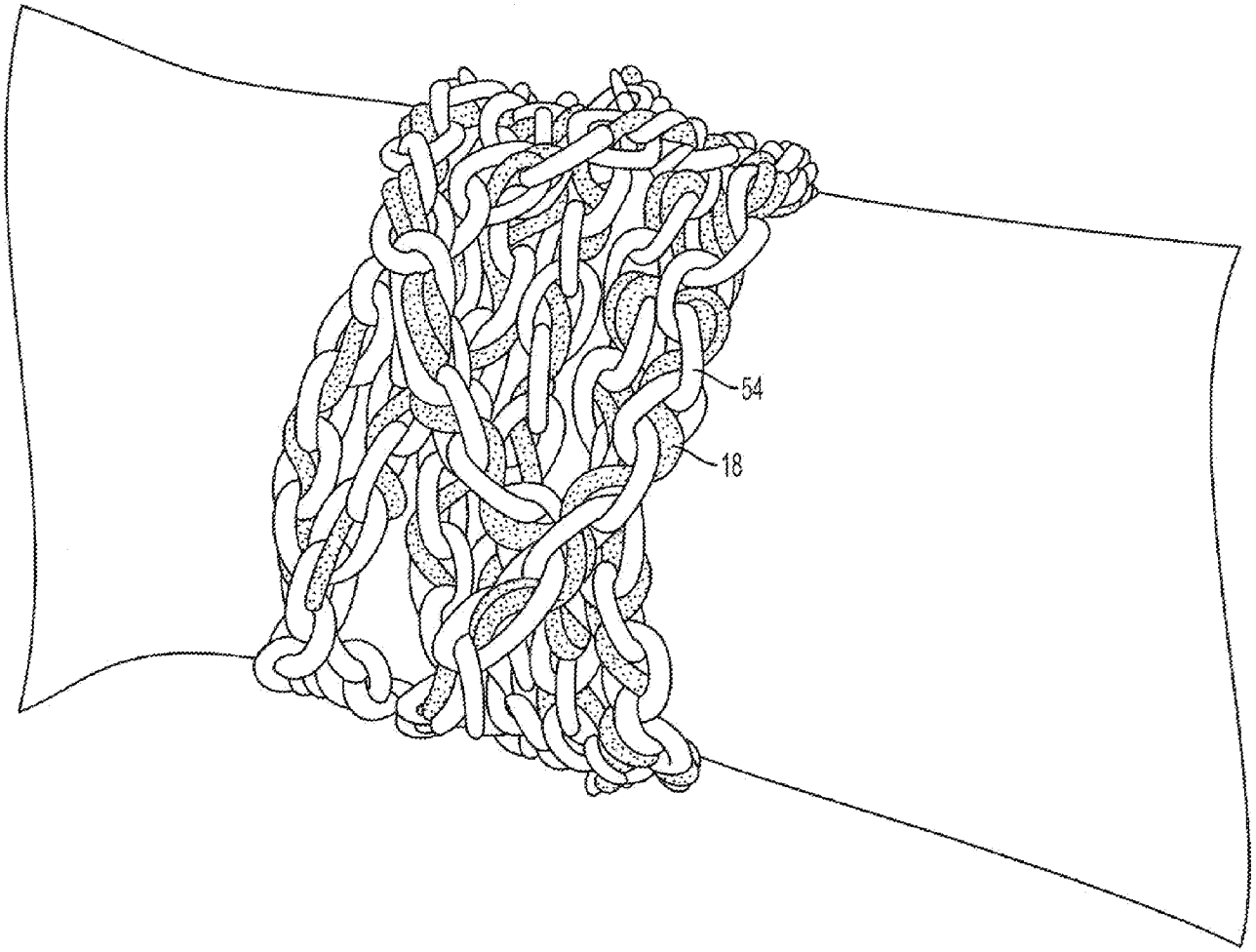
FIG. 7 is another view of FIG. 6.
Figure 8A:
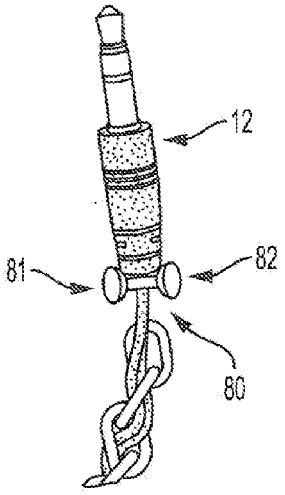
FIGS. 8A, 8B, and 8C show examples of different magnets, according to embodiments.
Figure 8B:
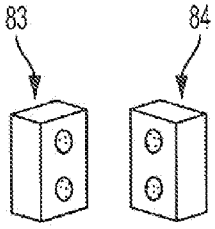
Figure 8C:
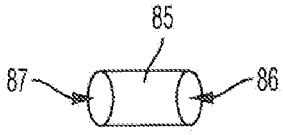

FIG. 1 shows exemplary headphones 10 that can be converted into an accessory by forming one or more loops. The generally Y-shaped configuration of headphones 10 includes a male plug member 12 coupled to a proximal end 14 of the headphones 10, and earphone or earbuds 20, 22, which indicate left and right earphone units respectively, are connected at distal ends 6, 16 of the headphones 10. The headphones 10 include cords (e.g., audio cables) such as a unitary lead cord 18 which extends from the male audio plug 12 to a collar 24 from which two branched cords 26, 28 extend into left and right cords 26, 28. The left and right cords 26, 28 terminate in the earphones 20, 22, respectively, which give the headphones 10 an overall Y-shaped configuration. As shown in FIG. 1, an electronic device 30 comprises a mating member 32, such as a female socket or jack, which couples to the male audio plug 12 of the headphones 10 for transmission of electronic sound data from the electronic device 30 to the earphones 20, 22. On each of the earphones 20, 22, magnets 42, 46 are coupled by respective coupling members 40, 44, which have the same polarity side exposed so that they repel instead of attract each other. Similarly on the male plug member 12, magnet 50 and magnet 51 are coupled with a coupling member 48. Magnets 50 and 51 can be two different magnets, as shown in FIGS. 1 and 2. In some aspects, magnet 51 can be removed and magnet 50 can be a double-headed magnet with the same polarity on both sides, as shown in FIGS. 8A-8C. The coupling members 40, 44, 48 can be removably attached or permanently affixed to their respective cords of the headphones 10 and/or the various chains or wires described below with reference to examples in FIGS. 3-7 and 9A-9E. Magnets 42, 46 can be moveable with respect to the audio cables with which they are coupled. FIG. 4 shows a close-up view of the earphones 20, 22 and the male audio plug 12 with associated magnets. The coupling members 40, 44, 48 can use a variety of mechanisms to couple with the respective magnets, such as, but not limited to, a removable fastener (such as a jump ring or lobster clip), an epoxy, a resin, a solder. The coupling members 40, 44 can comprise respective apertures that are sized to accommodate a portion of the cords 26, 20, such as distal ends 6, 16 of the headphones 10 and/or an accessory, such as a chain or a string that is decorating the headphone cord, as discussed below.

In some aspects of headphones 10 of FIG. 1, one or both earphone units 20, 22 can be coupled to or include a portion of a magnetically attracted material that can be used instead of magnets 42, 46. The magnetically attracted material can be selected from, but not limited to, a diamagnetic material, paramagnetic material, ferromagnetic material, superparamagnetic material, molecule-based magnetic material, spin glass magnetic material, or a polymer-based magnetic material, or other magnetically attracted materials. In this aspect, one or both of earphone units 20, 22 can be coupled to or include magnetically attracted materials that can be magnetically coupled to magnet 50 or magnets 50 and 51 near the male audio jack 12. Alternatively, male audio jack 12 can be coupled to or be formed of a magnetically attracted material, as discussed above, and earphone units 20, 22 can include magnets 42, 46 in order to form the loop that can be worn as an accessory.

FIG. 2 is another example of headphone set that is similar to FIG. 1, except that the headphone comprises a single earphone 20. The loop can be formed when magnet 42, located near earphone 20, is magnetically coupled to magnet 50, located near audio jack 12. As above, the design of the coupling mechanism and magnets can vary.

Figure 3:
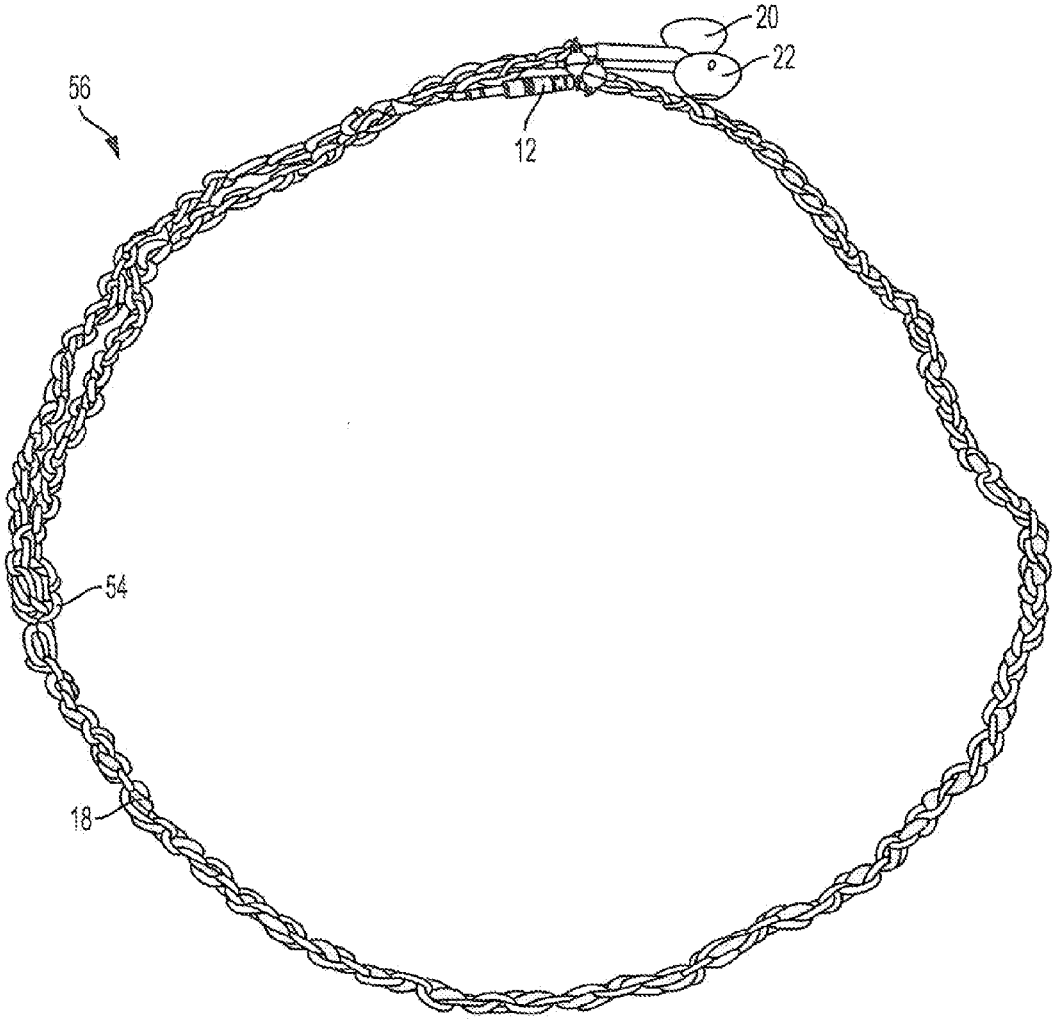
FIG. 3 is a top view of one example earbud headphones where a loop has been formed by connecting the earbuds to the audio jack, according to embodiments of the present disclosure.
Figure 4:
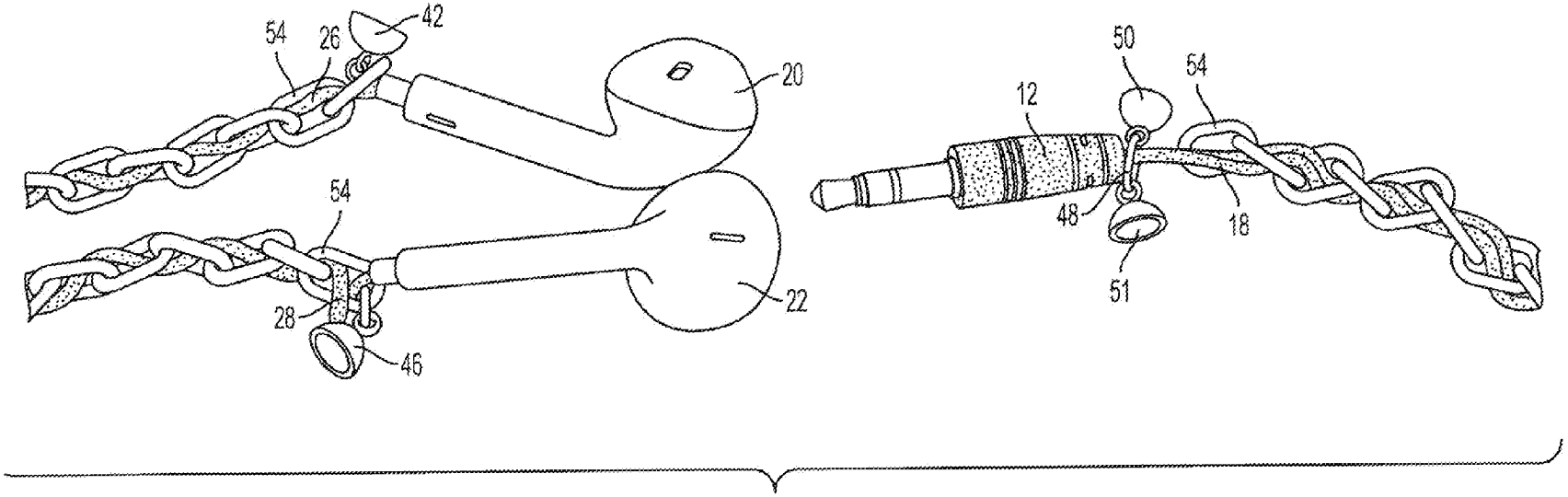
FIG. 4 is a view of the magnets as attached to the earbuds and the audio jack of FIG. 1 and not yet connected to each other. The magnets on the earbuds are of the same polarity, thereby they will not connect to each other. The magnets on the audio jack are of an opposite polarity so therefore they will be attracted to the magnets on the earbuds.

FIG. 3 is a top view of one example earbud headphones where a loop has been formed by connecting the earbuds to the audio jack, according to embodiments of the present disclosure. As shown in FIG. 3, the cords 18 of the headphone set are decorated with a chain 54 and form a loop 56 of sufficient diameter to be worn as a necklace, bracelet or other accessory.

FIG. 4 is a view of the magnets as attached to the earbuds and the audio jack of FIG. 1 and not yet connected to each other. The magnets on the earbuds are of the same polarity to prevent connection to each other. The magnets on the audio jack are of an opposite polarity to attract the magnets on the earbuds.

Figure 5:
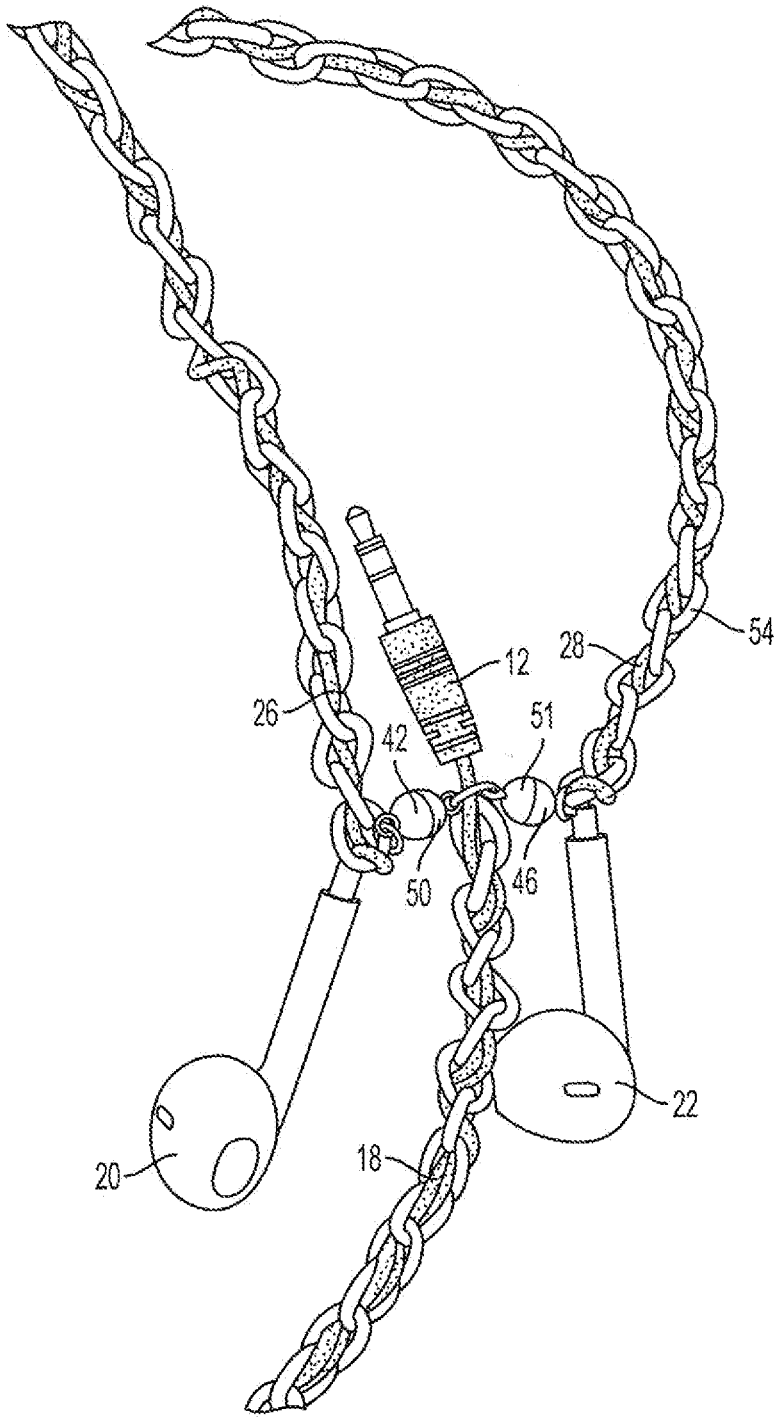
FIG. 5 is a view of the magnets connected to each other, according to embodiments.

FIG. 5 is a view of the magnets connected to each other, according to embodiments. As shown in FIG. 5, magnet 42 and magnet 50 are coupled to each other and magnet 46 and magnet 51 are coupled to each other. In the embodiment where magnet 50, disposed near audio jack 12, is a single, double headed magnet, magnet 51 can be removed. Also, magnet 46 and magnet 50 can be coupled together and magnet 42 and magnet 51 can be coupled together.

Figure 6:
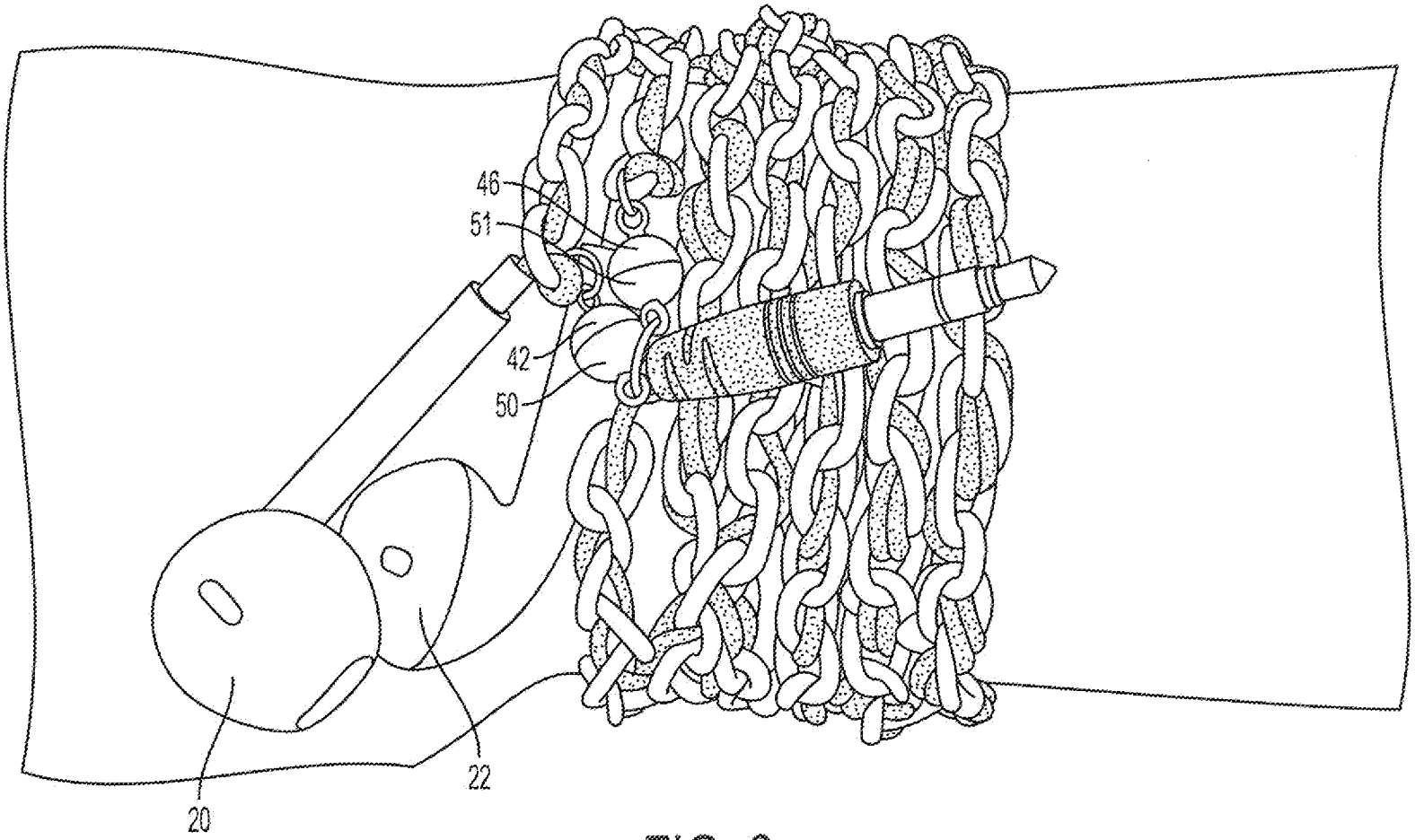
FIG. 6 is another example of the earbud headphones worn around the wrist forming multiple loops to be worn as a bracelet, according to embodiments.

FIG. 6 is an example of the headphones forming multiple loops to be worn as a bracelet, according to embodiments. FIG. 7 is another view of FIG. 6, according to embodiments.

As discussed above, the cord of the headphones form a loop 56 of sufficient diameter to be worn as an accessory, such as around a neck of a user (as shown in FIG. 3), wrist of a user (as shown in FIGS. 6 and 7), or arm or waist of the user. This can be done when the headphones are not in use by having either one or both magnets 42, 46 magnetically coupled to magnets 50, 51 (or single magnet 50). The cord or audio cable 18 of the headphone can be decorated, for example with chain 54, so that they look more attractive. Once loop 56 is made and the ends are connected to each other, loop 56 can be rotated so that the earbuds reside behind the neck, wrist, or waist of the user.

The number of loops made can be varied, resulting in a single strand or multiple strands. This is done by either (1) wrapping the wires multiple times around the body part before the loop 56 is formed or (2) wrapping the wires multiple times after the loop 56 is formed.

Figure 8D:
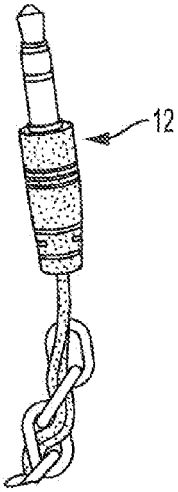
FIG. 8D shows an example of the audio jack including material that can be attracted to a magnet, according to embodiments.

FIGS. 8A, 8B, and 8C show examples of different magnets, according to embodiments. The magnet, described above as magnet 50, disposed near the audio jack 12 can be a single, double-headed magnet. In this aspect, magnet 80 can comprise magnet surfaces 81 and 82, as shown in FIG. 8A. FIG. 8B shows another example of magnet 80 having magnetic surfaces 83 and 84. FIG. 8C shows still another example of magnet 85 having magnetic surfaces 86 and 87. Magnetic surfaces 81, 82, 83, 84, 86, and 87 can magnetically couple with magnets 42, 46, which also can have designs as outlined in FIGS. 8B and 8C. The earbuds can have these different shaped magnets as well. FIG. 8D shows an example where the magnet is replaced with a material that can be magnetically attracted to a magnet. As shown in FIG. 8D, the audio jack 12 can include the material that can be magnetically attracted.

Figure 9A:
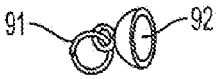
FIGS. 9A, 9B, 9C, 9D, and 9E show examples of different coupling members, according to embodiments.
Figure 9B:
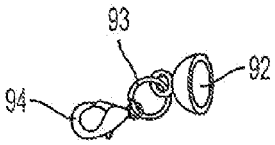
Figure 9C:
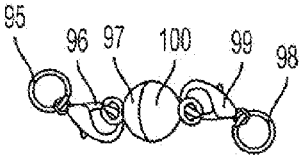
Figure 9D:
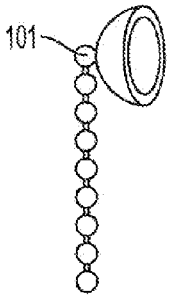
Figure 9E:
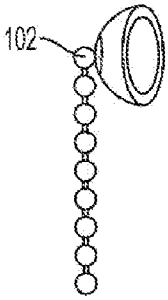

FIGS. 9A-9E show examples of different coupling members, according to embodiments, where FIGS. 9A-9C show example of a removable connection and FIGS. 9D and 9E show example of a permanent connection. FIG. 9A shows a coupling member in the form of a jump ring 91 that can be coupled to magnet 92. Additional chains or wires can pass through the aperture of jump ring 91. FIG. 9B shows a coupling member in the form of a lobster clip 94 connected to a jump ring 93, which are connected to magnet 92 having an exposed polarity side. FIG. 9C shows a jump clip 95 that can be connected to audio jack 12 at one end and connected to lobster clip 96 and magnet 97 at the other end. Similarly, another jump clip 98 can be connected to an earbud at one end and lobster clip 99 and magnet 100 at the other end. Magnets 97 and 100 can then be magnetically coupled together. FIG. 9D shows an example of a solder or glue bead connection 101 and FIG. 9E shows an example of a fast cure polymer connection 102 where the beads that are shown can be decorations around the wire.

The decoration around the wire can take multiple forms. For example, the headphone wires can be threaded through a metallic chain, where the wires and/or chains can be of any color. The headphone wires can be threaded through beads, which can be made of different materials, finishings and colors. For example, the beads can be pearl-like beads, metallic beads, crystal beads, or plastic beads. The headphone wires can be wrapped or encased in thick or thin threads that can be of any color and texture. Additional decorations can be added to the wire to act as decoration. These can include but are not limited to stamped metals, decorative chains, charms, and stones. The decorations can include one or more of the above components that can be coupled to the audio cable. The decorations can be coupled to the audio cable, for example, by using a chain by threading, by a wire intertwined with the audio cable, a bead threaded around the audio cable, and/or charms coupled to the audio cable.

The foregoing description of the disclosure, along with its associated embodiments, has been presented for purposes of illustration only. It is not exhaustive and does not limit the disclosure to the precise form disclosed. Those skilled in the art will appreciate from the foregoing description that modifications and variations are possible in light of the above teachings or may be acquired from practicing the disclosure. For example, the steps described need not be performed in the same sequence discussed or with the same degree of separation. Likewise various steps may be omitted, repeated, or combined, as necessary, to achieve the same or similar objectives. Similarly, the systems described need not necessarily include all parts described in the embodiments, and may also include other parts not describe in the embodiments.

Accordingly, the disclosure is not limited to the above-described embodiments, but instead is defined by the appended claims in light of their full scope of equivalents.

The invention claimed is:

1. A system for magnetically coupling headphones to form one or more loops, the system comprising:

a first earbud of the headphones coupled to a first magnet having a first polarity side and second polarity side, wherein the first polarity side of the first magnet is exposed;

a second earbud coupled to a second magnet having a first polarity side and a second polarity side, wherein the first polarity side of the second magnet is exposed;

an audio jack of the headphone, wherein the audio jack is coupled by a coupler to a third magnet and a fourth magnet, wherein the third magnet and the fourth magnet have a second polarity side exposed, wherein the first polarity is opposite the second polarity;

an audio cable connecting the first earbud and the second earbud to the audio jack, wherein the audio cable has a length sufficient to form a loop that can be worn as an accessory by a user when the first magnet is magnetically coupled to the third magnet and the second magnet is magnetically coupled to the fourth magnet.

2. The system of claim 1, wherein the audio cable is further accessorized with one or more additional components comprising a chain, a thread, multiple threads, a wire, a string of beads, or a string of charms, wherein the one or more additional components are coupled to the audio cable.

3. The system of claim 1, wherein the first magnet is coupled near a first junction of the first earpiece and a first audio cable and the second magnet is coupled near a second junction of the second earbud and a second audio cable.

4. The system of claim 1, wherein the first magnet and the second magnet are coupled using a selectively removable connection.

5. The system of claim 1, wherein the first magnet and the second magnet are coupled using a permanent connection.

6. The system of claim 5, wherein the permanent connection is based on epoxy, resins, or solder.

* * * * *